US012686472B2

(12) United States Patent
Williams

(10) Patent No.: US 12,686,472 B2
(45) Date of Patent: Jul. 21, 2026

(54) VALUABLES FLOTATION DEVICE (VFD)

(71) Applicant: Don P Williams, Harvest, AL (US)

(72) Inventor: Don P Williams, Harvest, AL (US)

( * ) Notice: Subject to any disclaimer, the term of this patent is extended or adjusted under 35 U.S.C. 154(b) by 377 days.

(21) Appl. No.: 18/504,422

(22) Filed: Nov. 8, 2023

(65) Prior Publication Data

US 2025/0145253 A1 May 8, 2025

(51) Int. Cl.
*B63B 22/22* (2006.01)

(52) U.S. Cl.
CPC ..... *B63B 22/22* (2013.01)

(58) Field of Classification Search
CPC ..... B63B 7/082; B63B 7/08; B63B 22/22; B63B 22/12
See application file for complete search history.

(56) References Cited

U.S. PATENT DOCUMENTS 3,256,539 A * 6/1966 Clark ..... B63B 22/22 367/130
4,578,041 A * 3/1986 Heitkamp, III ..... A01K 97/00 441/95
5,030,152 A * 7/1991 Carr ..... B63C 9/08 441/89
5,210,525 A * 5/1993 Lennon ..... G08B 21/24 362/116
5,286,462 A * 2/1994 Olson ..... C01B 3/065 114/54
7,232,354 B2 * 6/2007 Olson ..... B63B 22/12 441/7
7,261,606 B2 * 8/2007 Mickelson ..... A44B 15/005 441/6
7,540,796 B2 * 6/2009 Spears ..... B63B 22/08 441/8
8,430,704 B2 * 4/2013 Jeffrey ..... B63B 22/166 441/16
8,821,206 B2 * 9/2014 Van Mil ..... B63B 22/12 441/98
8,961,250 B2 * 2/2015 Meyer ..... B63C 9/18 441/98
9,650,112 B1 * 5/2017 Milam ..... F41C 27/00
9,803,951 B1 * 10/2017 Mashburn ..... F41B 5/14
10,236,930 B1 * 3/2019 Ferraro ..... H04B 1/3888
10,343,751 B2 * 7/2019 Hollen ..... B63C 9/18
11,124,273 B2 * 9/2021 Prevel ..... B63B 22/003
(Continued)

FOREIGN PATENT DOCUMENTS

FR 2733482 A1 * 10/1996 ..... B01J 7/02
GB 2406265 A * 3/2005 ..... A44B 15/005
(Continued)

*Primary Examiner* — Magdalena Topolski

(57) ABSTRACT

A water activated, self-inflating, automatic floatation device that can be easily attached to small personal items of value for easy retrieval if accidentally dropped into a deep or low visibility body of water such as a lake, pond, stream, river, or ocean. The automatic flotation device is comprised of a housing, an inflatable bladder, water activated gas producing compound, an orifice plate, a gas expansion port, and a removable housing cover. The automatic floatation device will inflate the bladder regardless of orientation under water. The automatic floatation device is small enough that it can be attached to glasses, keys, cell phones, hats, basically any small personal item of value.

20 Claims, 12 Drawing Sheets

(56) References Cited

U.S. PATENT DOCUMENTS

| | | | | |
|---|---|---|---|---|
| 12,195,141 | B2 * | 1/2025 | Magnusson | A01K 97/00 |
| 2004/0009721 | A1 * | 1/2004 | Stoelinga | B63B 22/10 441/7 |
| 2016/0374437 | A1 * | 12/2016 | King | B63B 21/20 441/9 |
| 2018/0115638 | A1 * | 4/2018 | Bower | H04M 1/0249 |
| 2024/0409187 | A1 * | 12/2024 | Wang | A47C 15/006 |

FOREIGN PATENT DOCUMENTS

| | | | | | |
|---|---|---|---|---|---|
| GB | 2507292 | A | * | 4/2014 | A44B 15/00 |
| JP | 3091738 | U | * | 2/2003 | |
| KR | 20020027295 | A | * | 4/2002 | |
| KR | 100768930 | B1 | * | 10/2007 | B63B 22/12 |
| WO | WO-2021024022 | A1 | * | 2/2021 | B63B 22/22 |

* cited by examiner

VALUABLES FLOTATION DEVICE (VFD)

CROSS-REFERENCE TO RELATED APPLICATIONS

This application is related to and claims priority to U.S. Provisional Patent Application No. 63/475,603, entitled "Valuables Flotation Device (VFD)" filed on Nov. 25, 2022, which is incorporated by reference herein.

FIELD OF THE INVENTION

The present invention generally relates to the field of automatic floatation devices, such as inflatable balloons, bobbers, floats. More specifically, the invention pertains to such flotation devices that are very small, that can be easily applied to small personal items without being in the way, that automatically activates when dropped into water, and that floats the device it is attached to the surface for easy retrieval.

RELATED ART

There have been many disclosures and attempts by others to make a device that can be attached to various valuables like fishing rods, guns, keys, cell phones, but they have all fallen short because there is nothing commercially available that is practical to use and cost effective to purchase. Most attempts have been by using a compressed gas cartridge with some sort of water sensitive trigger to release said gas from cartridge. See for example, U.S. Pat. No. 7,540,796 by Spears et al, U.S. Pat. No. 6,036,359 by Arnold et al, U.S. Pat. No. 8,430,704 by Jeffrey, U.S. Pat. No. 10,343,751 Hollen et al. These inventions are not practical to apply to smaller, everyday use items like glasses, keys, hats, cell phones due the size of the gas cartridge required and, also due to the fact they require water sensitive triggers that make everyday use not practical due to rain, humidity and moisture. Other attempts have been made by using a compound that produces gas when mixed with water combined with a mechanical one-way valve assembly to let water in as the device sinks. See for example, U.S. Pat. No. 8,961,250 by Meyer, U.S. Pat. No. 10,236,930 by Ferraro. These inventions are not practical to apply to smaller use items like glasses, keys, and hats, because the one-way valves are comprised of springs and balls. Furthermore, some do not provide for a way for air to escape the apparatus as it sinks. Air must escape in order to let water into the apparatus, or it becomes air locked, and no water can enter. This air lock phenomena of the past inventions also limits the utility of invention to the orientation of the device in the water, in other words it will only work in certain orientations, not all orientations. There are other inventions disclosed that use electronic circuitry to work. See for example, U.S. Pat. No. 5,210,525 by Lennon et al, U.S. Pat. No. 7,261,606 by Mickelson et al. The use of electronic circuitry requires a battery which limits the size and reliability of the invention. The battery must be changed regularly, or the reliability becomes low which yields a higher probability that the valuable to which the device is attached cannot be recovered.

A unique aspect of the present invention is that it uses an orifice plate combined with air relief and water inlet channels to simultaneously let water in and air out and does not require one-way valves like previous intentions to operate. This concept alone allows the design to be greatly simplified and miniaturized. Another unique aspect of the present invention is that it works regardless of the orientation in the water into which it is dropped, a fundamental shortcoming of previous inventions that made them unreliable.

It would be desirable to have a small, compact floatation device that can be attached to personal valuables like glasses, cell phones, keys, hats, basically anything that would sink if dropped into water, that would automatically activate and float the item to which it is attached to the surface if accidently dropped into a body of water like a lake, river, pond, or stream. It is also desirable for this new valuables floatation device to be designed such that it does not require the user to use the valuable to which it is attached in a different manner than the valuable without the device, in other words it is not a hinderance. It is also desirable for this new valuable floatation device be totally passive, not requiring any batteries, electronics, springs, balls, gas cartridges, rods, triggers, or water dissolvable components.

SUMMARY OF THE DISCLOSURE

Every year countless cell phones, sunglasses, hats, watches, keys, and other personal items are accidently dropped into lakes all over the world to never be recovered due to depth and visibility of the water. Every dock, every boat on every lake has had at least one cell phone casualty by the accidental dropping of someone's cell phone into the water never to be recovered; and expensive sunglasses are even more numerous in casualties. There are many devices on the market today like bulky floating cell phone bags that require the user to place their phone into a zip lock bag type device or bulky floating cases, but these are rarely used because it requires the user to plan ahead and adapt their lifestyle and use cases to that of the case because their phone must be placed inside the case or bag before each use. People are just too lazy and forgetful to do this all the time. Their needs to be a device that simply attaches to the cell phone or other valuable personal items and remains there all the time and does not require the user to change their lifestyle or use case or even have to think about it being there. If the cell phone or personal article is accidently dropped into the water, it floats to the surface in just a short period of time. No more lost personal valuables due to water. No more hassle of bags or cases to put your cell phone in. The solution is the valuables floatation device (VFD).

Generally, the embodiments of the present disclosure pertain to small, practical automatic floatation devices that can be semi-permanently attached to a personal valuable such as glasses, cell phones, keys, hats, watches, etc. The disclosure is directed toward anyone that goes swimming, boating, canoeing, or any other activity around a large body of water that has personal valuables that they do not want to lose if accidently dropped into the lake, river, stream, pond or ocean.

In accordance with an embodiment of the present disclosure, an automatic floatation device is described comprising a housing into which a compressed bladder and reactant is stored, a water inlet orifice, an air relief orifice, such that as the device sinks into a body of water, the water enters the water inlet orifice as the air inside the housing escapes the air relief orifice. Once the water enters the housing it reacts with the reactant producing gas that is forced into the bladder, inflating the bladder having enough buoyancy to float the article or valuable to which it is attached to the surface of the body of water for easy retrieval.

In another embodiment a method is provided for forcing the gas produced by the reactant into the bladder instead of allowing it to escape out of the air escape orifice.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

Generally, the embodiments of the present disclosure pertain to small, practical automatic floatation devices that can be semi-permanently attached to a personal valuable such as glasses, cell phones, keys, hats, watches, etc. The disclosure is directed toward anyone that goes swimming, boating, canoeing, or any other activity around a large body of water that has personal valuables that they do not want to lose if accidently dropped into the lake, river, stream, pond, or ocean.

Figure 1:
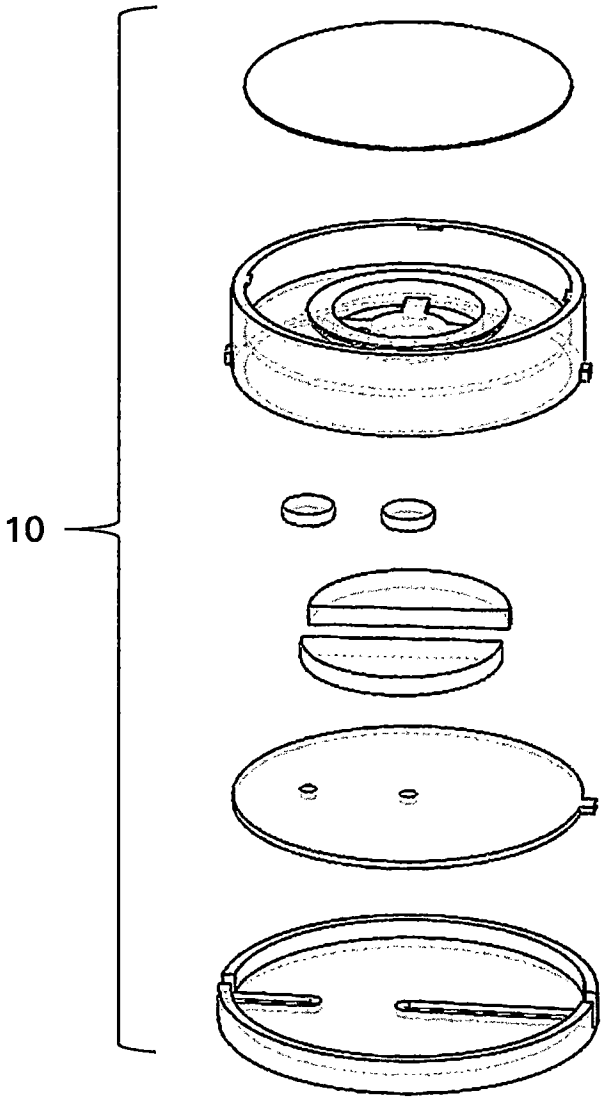
FIG. 1 illustrates an exploded view of the pieces that make up the first embodiment of the 10 valuables flotation device, but shown without the 101*a* compressed bladder illustrated because it would cover some of the various pieces of the present embodiment.

Referring to FIG. 1 there is illustrated the parts stack up of an apparatus referred to as a valuables flotation device (VFD) 10.

Figure 2:
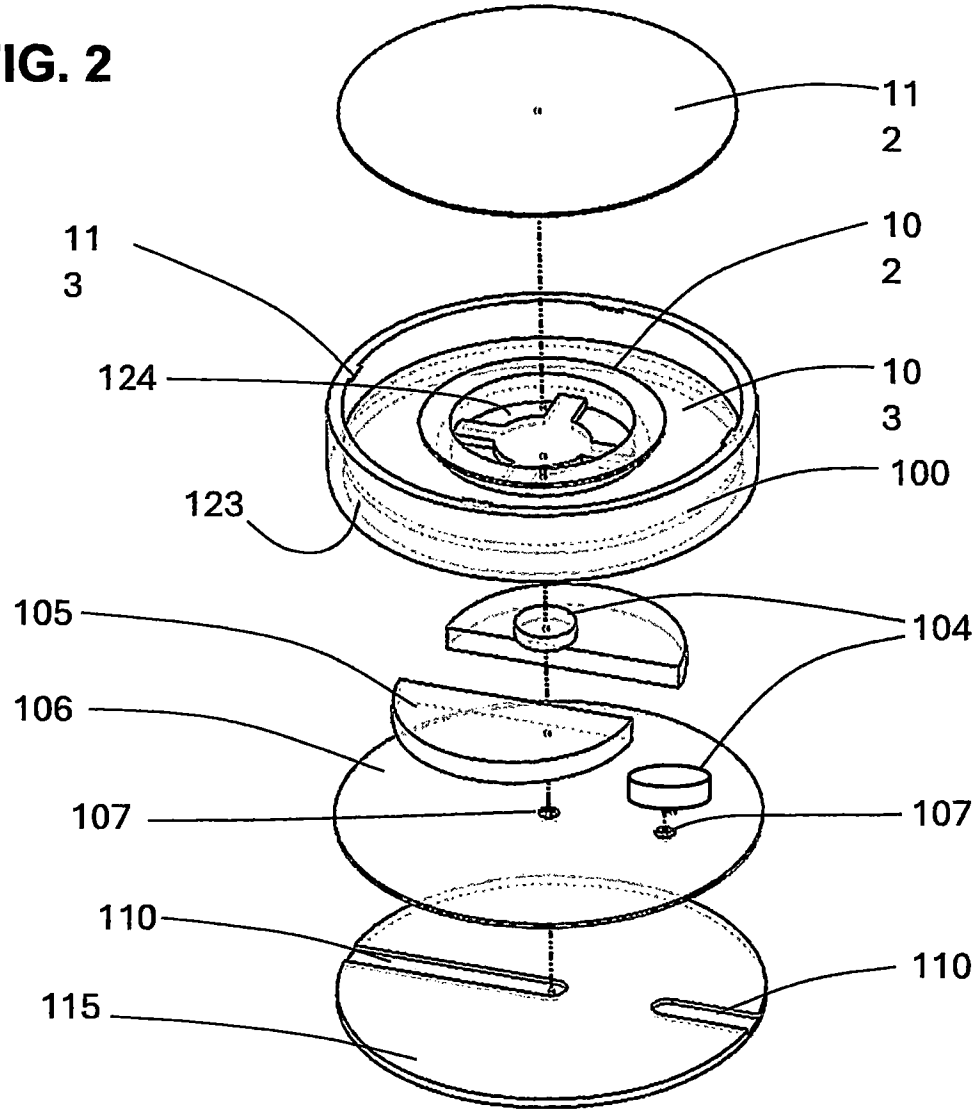
FIG. 2 illustrates and labels the various pieces of the present embodiment in accordance with the present disclosure, but without the 101*a* compressed bladder shown to demonstrate all the other parts of the embodiment.

Referring to FIG. 2 the present embodiment of the valuables floatation device 10 is illustrated with all parts shown and labeled except for the compressed bladder 101*a* which is left out to illustrate all other parts in detail. A housing 100 comprised of a bladder storage cavity 103 and a bladder seal attachment feature 102 to which the compressed bladder 101*a* can be attached with good seal and stored inside the housing 100; a reactant storage cavity 123 to store the reactant 105 and a port 124 between the bladder storage cavity 103 and the reactant storage cavity 123. Further comprised of press fit tabs 113 such that the press fit cap 112 can be attached securely, but also popped off by the inflated bladder 101*b* when filled with gas from the reactant 105. The housing 100 also houses the orifice plate 106 and bottom plate 114. These two plates will be described in detail in FIG. 6 and FIG. 7.

Figure 3:
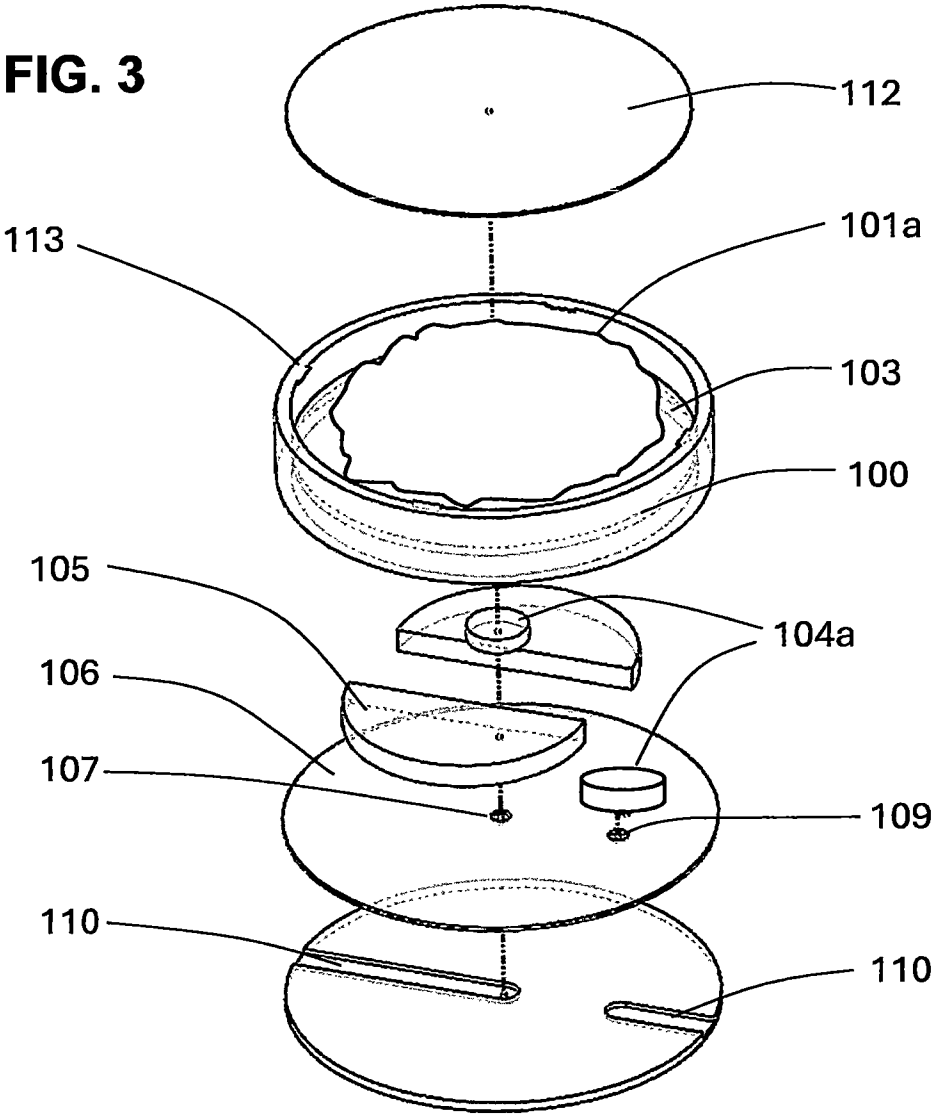
FIG. 3 illustrates the 101*a* compressed bladder inside the 100 housing to illustrate how it is stored inside the 103 bladder storage cavity inside the 100 housing. It should be noted that the size of the 100 housing and 101*a* compressed bladder will be determined by the weight of the target device that is to be floated.

Referring to FIG. 3 the compressed bladder 101*a* is incorporated to illustrate how it fits inside the bladder storage cavity 103.

Figure 4:
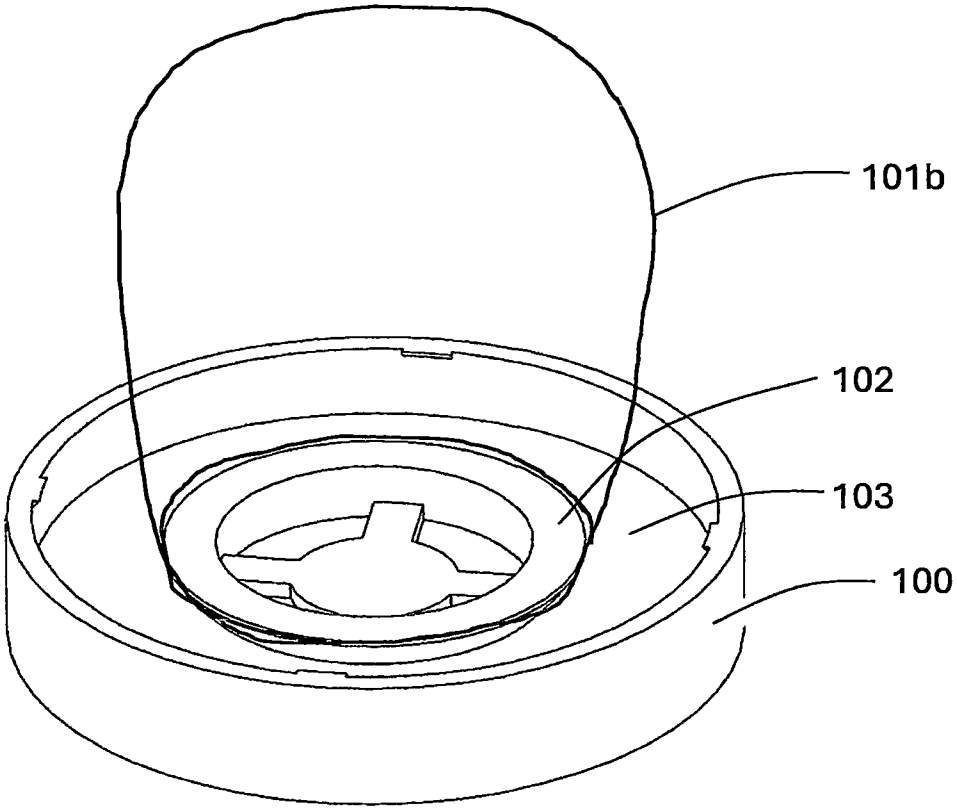
FIG. 4 illustrates the 101*b* inflated bladder and how it is attached to the 102 bladder seal attachment feature such that all the gas generated by the 105 reactant is forced into the bladder.

Referring to FIG. 4 the inflated bladder 101*b* is illustrated showing the invention in its fully deployed state. The Inflated bladder 101*b* is attached to the housing 100 using the bladder seal attachment feature 102 such that it does not separate from the housing 100 when it is filled with the gas produced by the reactant 105, thus floating the invention and the device to which it is attached to the surface of the water.

Figure 5:
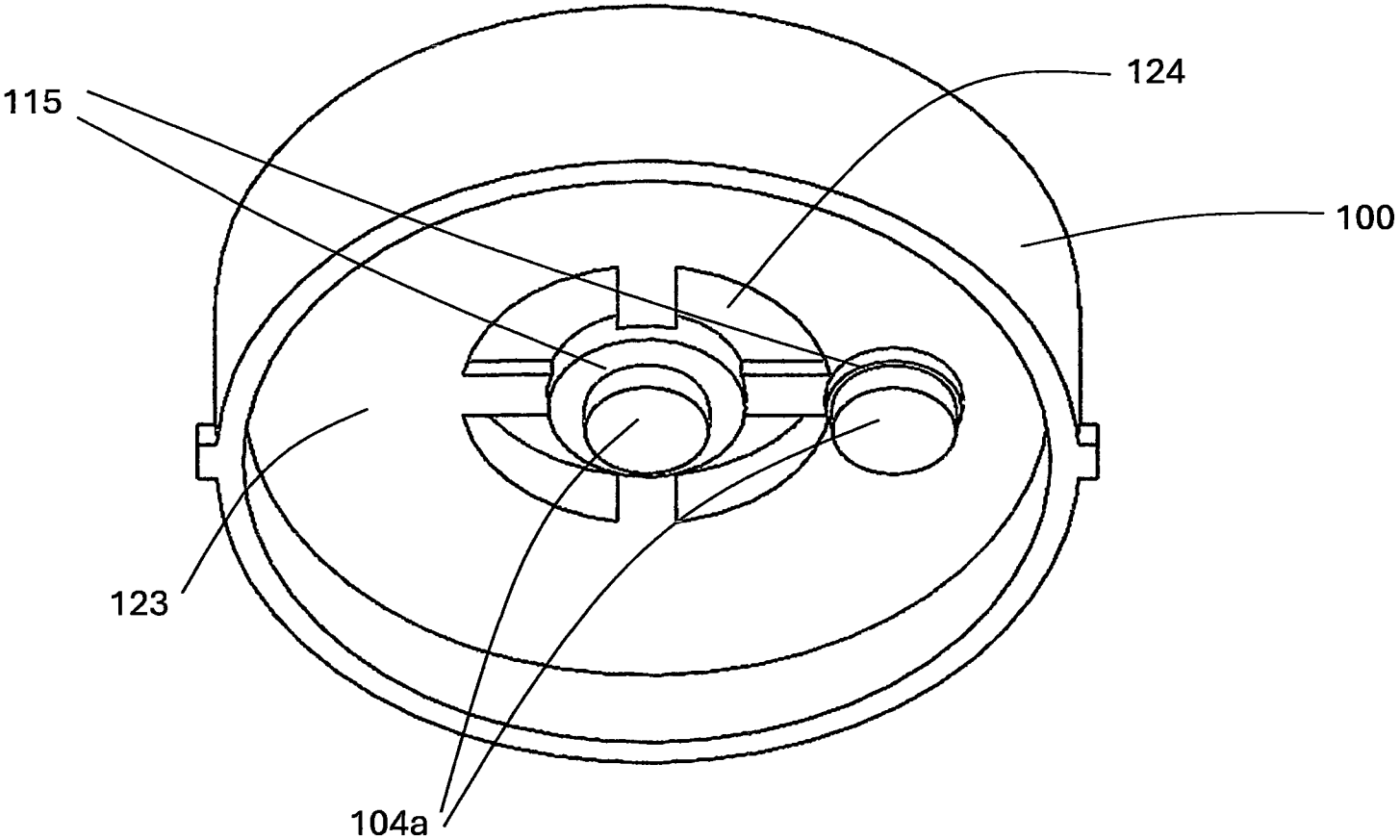
FIG. 5 illustrates how the 104*a* compressed hydro expanding element(s) are attached to the bottom of the 100 housing by 115 adhesive so as to be positioned over the 107 air relief orifice and 109 water inlet orifice illustrated in FIG. 7.

Referring to FIG. 5, the bottom of the housing 100 is shown to illustrate the reactant storage cavity 123 and the compressed hydro-expanding elements 104*a* attached to the housing 100 by adhesive 115. These hydro-expanding elements 104*a* will expand and cover the air relief orifice 107 and water inlet orifice 109 as illustrated in FIG. 7 when sufficient water enters the reactant storage cavity 123.

Figure 6:
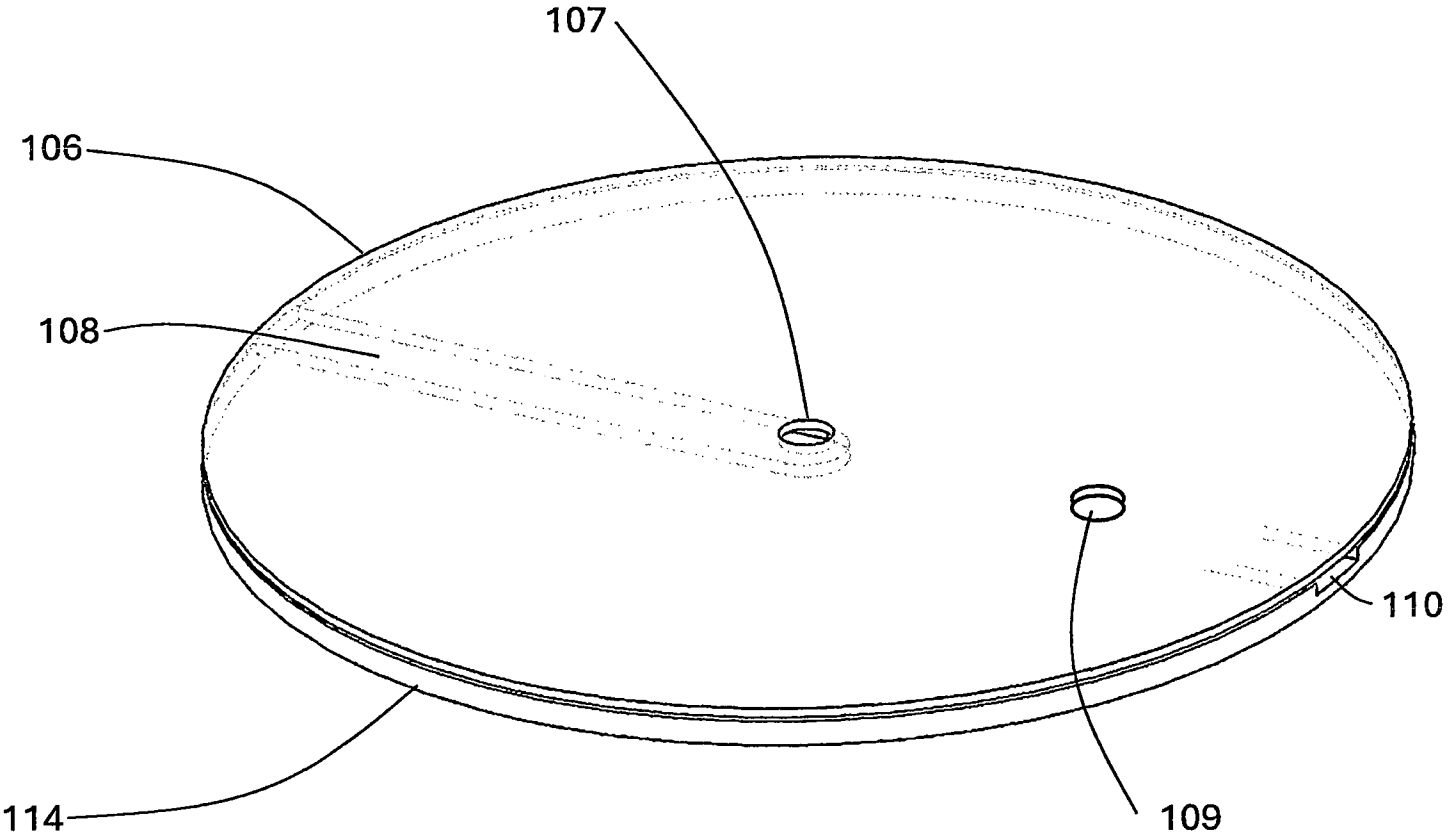
FIG. 6 illustrates an embodiment to control water flow into the apparatus while simultaneously controlling the flow of air escaping the apparatus. Water can only flow into the apparatus at the rate that air escapes the apparatus. If air cannot escape, the apparatus becomes air locked and will not work. Once enough water flows through the water 109 inlet orifice into the apparatus to cause the 105 reactant to start the reaction to produce gas, then the 107 air relief orifice has to be closed or all the gas produced by the 105 reactant will simply go out the 108 air relief channel and not fill up the 101*a* compressed bladder. This orifice design is paramount to the desired operation of this new invention.

Referring to FIG. 6 the orifice plate 106 and the bottom plate 114 are illustrated. The orifice plate 106 contains an air relief orifice 107 and a water inlet orifice 109. The bottom plate 114 contains an air relief channel 108 and a water inlet channel 110. The combination of the orifice plate 106 and the bottom plate 114 and the size of the air relief orifice 107 and the size of the water inlet orifice 109 are unique to the successful and reliable operation of this invention. As the device to which the invention is attached sinks in the water, air is allowed to escape through the air relief orifice 107 and the air relief channel 108 while water enters the invention through the water inlet channel 110 and into the reactant storage cavity 123 through the water inlet orifice 109. For water to enter the reactant storage cavity 123, air must escape the reactant storage cavity 123 at the same rate. The method and means by which this accomplished must be finely tuned according to the size of the invention and the device to which it will be attached. Furthermore, the design of the orifice plate 106, the air relief orifice 107, air relief channel 108, the water inlet orifice 109, and the water inlet channel 110 are designed such that normal everyday moisture like sweat, rain, liquid spills do not penetrate the reactant storage cavity 123, otherwise the device would falsely deploy and not be reliable. This design without incorporating valves to prevent of water entering the invention unless submerged is another unique feature of this invention. It should also be noted that the orientation of the invention and the device to which it is attached does not matter when dropped into the water. Air will escape and water will enter no matter the orientation. The ability to work regardless of orientation is yet another unique feature of this invention that makes it reliable in all scenarios and situations.

Figure 7:
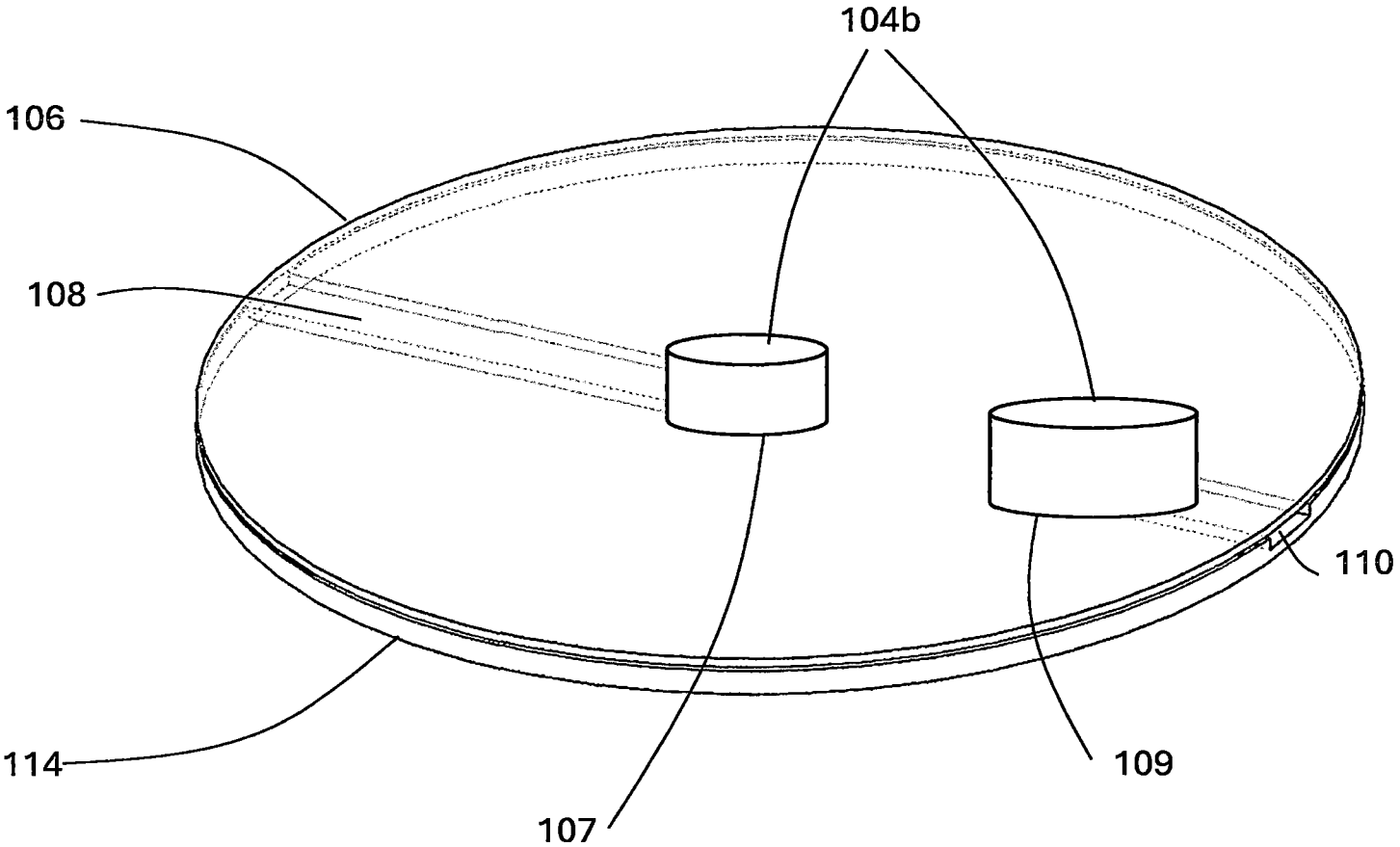
FIG. 7 illustrates the 104*b* expanded hydro expanding elements covering up and closing the 107 air relief orifice and the 109 water inlet orifice.
Figure 8:
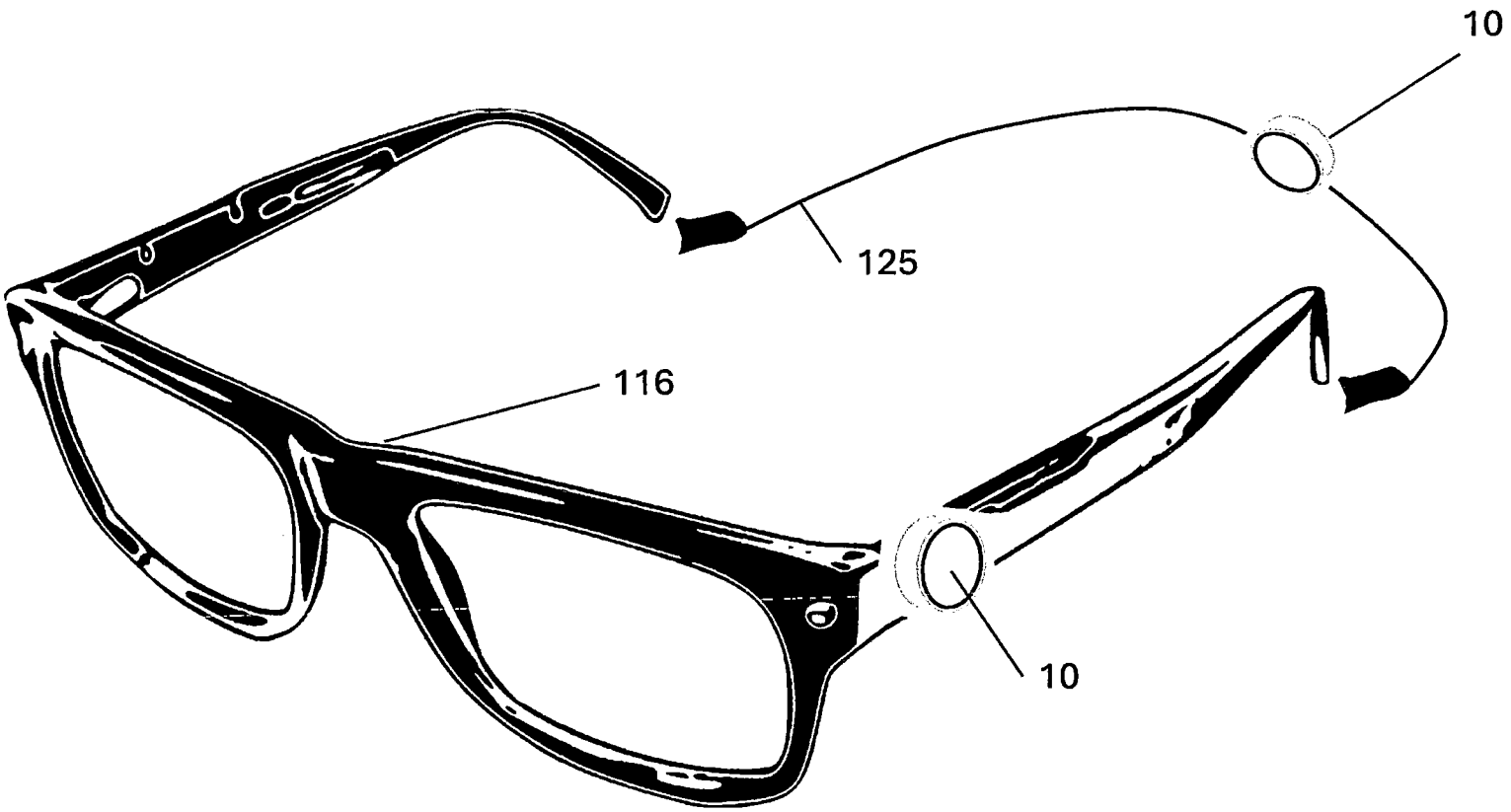
FIG. 8 illustrates the 10 valuables flotation device being attached to a pair of 116 glasses and alternatively attached to a 125 eyewear retainer. This is just a couple of examples of the ways the 10 valuables flotation device could be attached to sunglasses, prescription glasses, or any other type of glasses.
Figure 9:
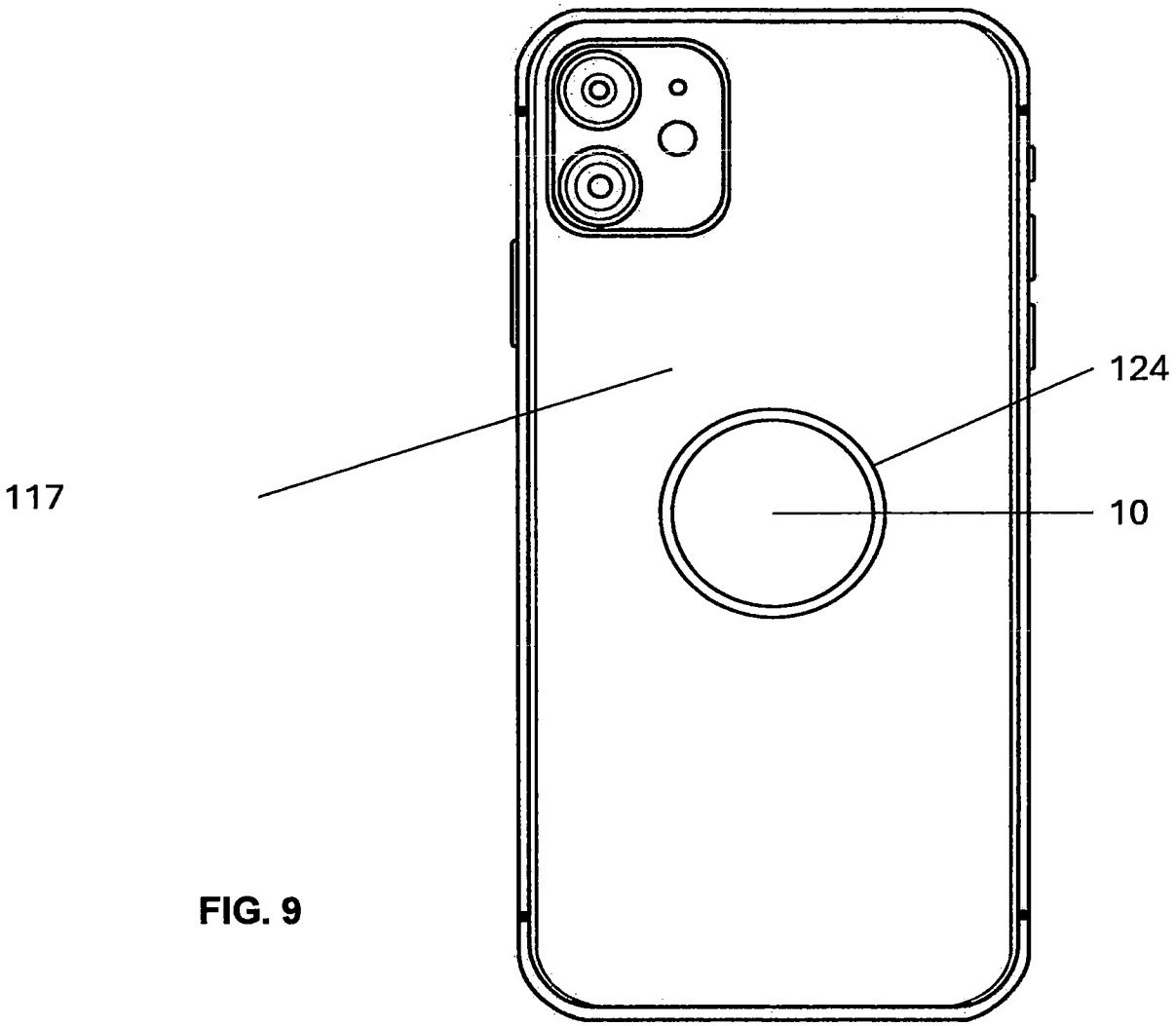
FIG. 9 illustrates the 10 valuables floatation device being attached to a 117 cell phone using a 124 magnet for attaching to MagSafe phone. This is just and example and could be attached to the cell phone case or made into the cell phone case.
Figure 10:
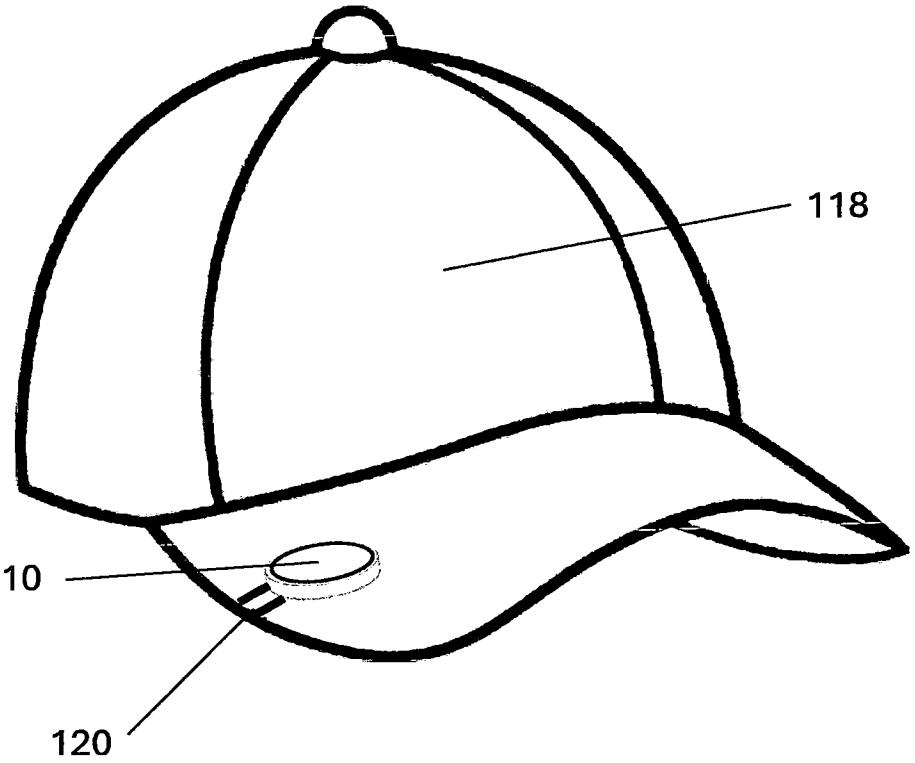
FIG. 10 illustrates the 10 valuables floatation device being attached to a 118 hat via a 120 hat clip. This is just an example and could be attached to ball caps, fashion hats, beanies, basically any article worn on the head. It also could be attached to such article via a pin, clip, magnet, basically any attachment method that does not harm the article it will be floating in the case it is accidently dropped into water.
Figure 11:
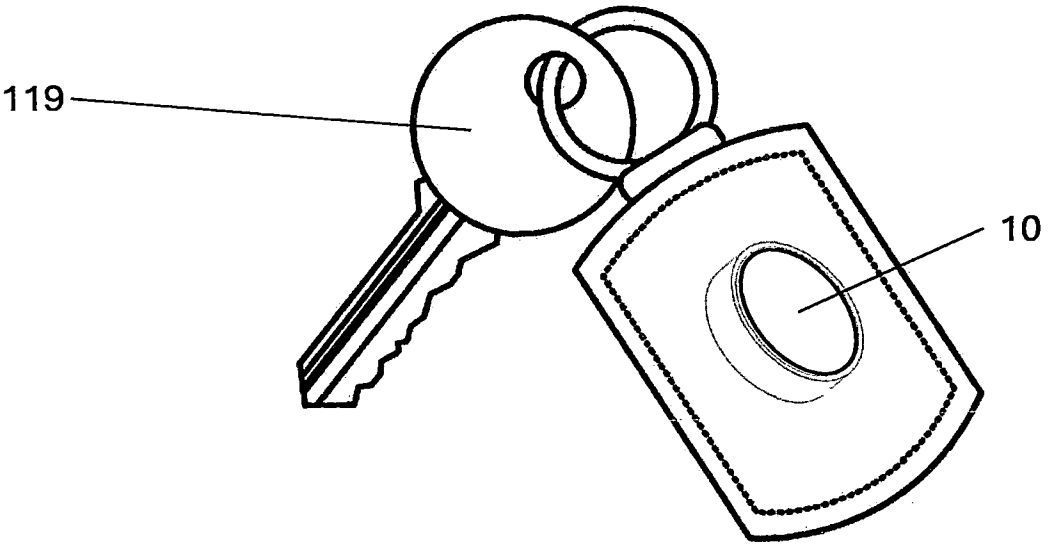
FIG. 11 illustrates the 10 valuables floatation device being attached to a 119 key chain. This is just one example of personal articles that the apparatus could be attached to float the article to the surface in the case the article was accidentally dropped into water.
Figure 12:
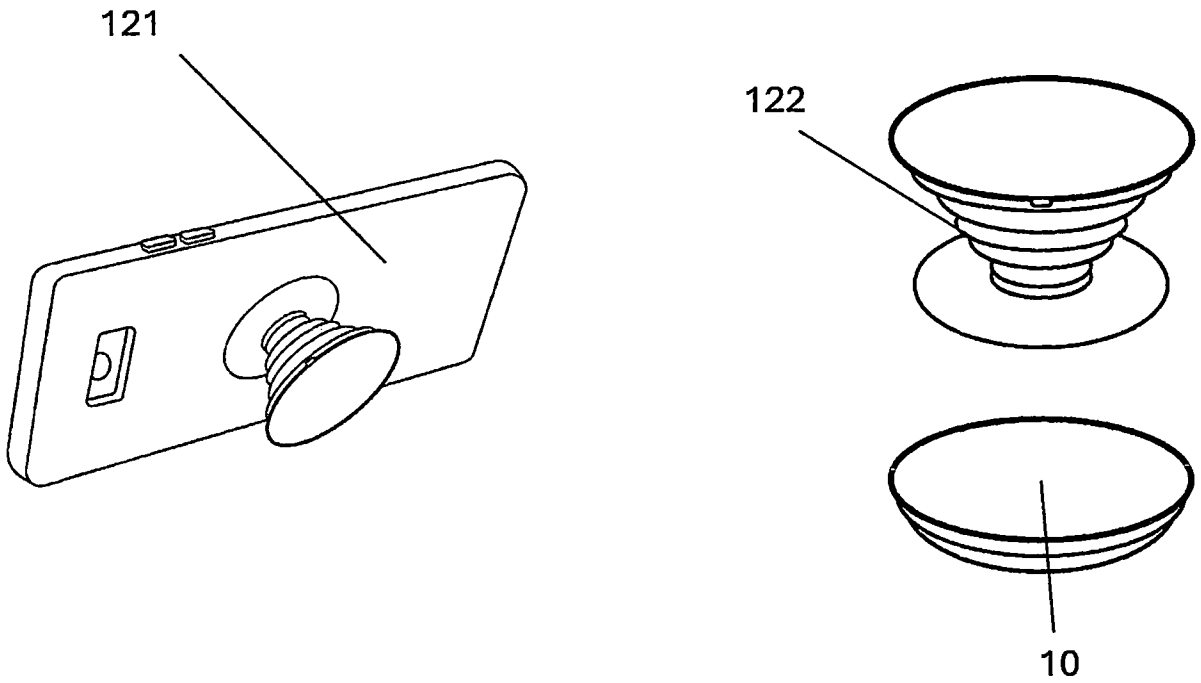
FIG. 12 illustrates the 10 valuables floatation device being incorporated into a 122 PopSocket® form factor. There are many 121 cell phone cases that have a pop socket connector on the back of them, so incorporating it into a pop socket attachment could be easily achieved and not hinder current operation of pop socket in any way.

Referring to FIG. 7 the expanded hydro-expanding elements 104*b* are illustrated covering up the air relief orifice 107 and the water inlet orifice 109 once sufficient water has entered the reactant storage cavity 123 to cause said reactant 105 to dissolve producing gas. By sealing off the air relief orifice 107 and the water inlet orifice 109, all the gas produced by the reactant 105 is forced into the compressed bladder 101*a* through the port 124 in the housing 100 between the reactant storage cavity 123 and the bladder storage cavity 103, whereby the inflated bladder 101*b* forces the press-fit cap 112 off the apparatus, emerges from the housing, and floats the invention and the device to which it is attached to the surface of the water to which it is dropped.

It should be further emphasized that the above-described embodiments of the present invention are merely possible examples of implementations and set forth for a clear understanding of the principles of the invention. Many variations, modifications, and combinations may be made to the above-described embodiments of the invention without departing substantially from the spirit and principles of the invention. All such modifications, combinations, and variations are intended to be included herein within the scope of this disclosure and the present invention and protected by the following claims.

Now, therefore, the following is claimed:

1. A water-activated, self-inflating apparatus attachable to a personal article, comprising:
- a housing containing:
  - a bladder storage cavity containing a compressed inflatable bladder; and
  - a reactant storage cavity containing a water-activated gas-producing compound; and
- a gas expansion port connecting the reactant storage cavity to the bladder storage cavity;
- an orifice plate containing:
  - a water inlet orifice permitting water to enter the reactant storage cavity; and
  - an air relief orifice permitting air to escape from the reactant storage cavity;
- one or more hydro-expanding elements positioned directly over both the water inlet orifice and the air relief orifice, the hydro-expanding elements:
  - (i) allowing simultaneous water entry and air escape as the apparatus sinks in water; and
  - (ii) expanding upon sufficient water exposure to seal both the water inlet orifice and the air relief orifice;
- wherein sealing of both orifices forces gas produced by the compound through the gas expansion port into the inflatable bladder;
- a bladder seal attachment feature securing the inflatable bladder to the gas expansion port; and
- a removable housing cover displaced by expansion of the inflatable bladder,
- whereby the inflatable bladder inflates regardless of underwater orientation and floats the attached personal article to the surface of a body of water.

2. The apparatus of claim 1, wherein the hydro-expanding elements expand radially to cover both orifices.

3. The apparatus of claim 1, wherein the orifice plate lacks spring-loaded or ball-type valves.

4. The apparatus of claim 1, wherein the water inlet orifice and the air relief orifice are sized to prevent activation from incidental moisture.

5. The apparatus of claim 1, wherein the water inlet orifice and air relieve orifice are filled with a water dissolving material to prevent activation from incidental moisture.

6. The apparatus of claim 1, wherein the removable housing cover is a press-fit cap.

7. The apparatus of claim 1, wherein the housing includes a magnet.

8. The apparatus of claim 1, wherein the housing is configured as a collapsible grip structure for attachment to a mobile device.

9. The apparatus of claim 1, wherein the housing is configured as an eyewear retainer.

10. A method of underwater inflation comprising:
- simultaneously permitting water entry and air escape through a water inlet orifice and an air relief orifice;
- expanding one or more hydro-expanding elements to seal both orifices;
- forcing gas generated by a water-activated compound into an inflatable bladder through a gas expansion port;
- whereby the bladder inflates and floats the apparatus regardless of underwater orientation.

11. The method of claim 10, wherein the water inlet orifice and the air relief orifice operate without spring-loaded valves, ball valves, or electronic control components.

12. The method of claim 10 wherein said forcing of produced gas into an inflatable bladder is accomplished by having a separate bladder storage cavity and a separate reactant storage cavity inside a housing that is connected by said gas expansion port.

13. The method of claim 10, wherein the water inlet orifice and air relief orifice are sized to prevent activation from incidental moisture including rain, humidity, or sweat.

14. The method of claim 10, wherein water enters the apparatus only at a rate permitted by air escaping through the air relief orifice.

15. A passive, water-activated flotation apparatus attachable to a personal article, comprising:
- a housing defining:
  - a reactant chamber containing a water-activated gas-producing compound; and
  - a bladder chamber containing a compressed inflatable bladder;

a gas expansion passage connecting the reactant chamber to the bladder chamber;

a fluid exchange interface including:

at least one water entry opening; and at least one air exit opening; a water-responsive sealing material;

wherein:

(i) the water entry opening and the air exit opening are configured to permit simultaneous inward water flow and outward air flow during submersion without the use of mechanical one-way valves;

(ii) the reactant chamber becomes fluidly isolated from the surrounding water after initial submersion by expansion of the water responsive sealing material positioned adjacent the fluid exchange interface;

(iii) isolation of the reactant chamber causes gas generated by the compound to increase internal pressure within the reactant chamber; and (iv) the increased internal pressure forces gas through the gas expansion passage into the inflatable bladder, causing the bladder to deploy from the housing and provide buoyancy;

whereby the apparatus inflates underwater regardless of spatial orientation and floats the attached personal article to the surface.

16. The water activated flotation apparatus of claim 15 wherein said housing is a collapsible grip structure attachable to a mobile device.

17. The water activated flotation apparatus of claim 15 wherein said housing contains a magnet for attaching to valuables.

18. The water activated flotation apparatus of claim 15 wherein said housing is the form factor of a peel and stick label.

19. The water activated flotation apparatus of claim 15 wherein said housing is in the form factor of an eyewear retainer.

20. The water activated flotation apparatus of claim 15 wherein said housing is attached to a pin clip for mounting.

* * * * *